US006606783B1

(12) United States Patent
Kawase et al.

(10) Patent No.: US 6,606,783 B1
(45) Date of Patent: Aug. 19, 2003

(54) METHOD OF PRODUCING CHIP THERMISTORS

(75) Inventors: Masahiko Kawase, Shiga (JP); Norimitsu Kitoh, Shiga (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 22 days.

(21) Appl. No.: 09/670,298

(22) Filed: Sep. 26, 2000

Related U.S. Application Data

(62) Division of application No. 09/124,194, filed on Jul. 28, 1998, now Pat. No. 6,184,772.

(30) Foreign Application Priority Data

Aug. 7, 1997 (JP) ..... 9-213413

(51) Int. Cl.[7] ..... H01C 7/04; H01C 7/10

(52) U.S. Cl. ..... 29/612; 29/610.1; 29/25.03; 29/25.42; 29/619; 29/620; 338/22 R; 338/204; 338/22 SD

(58) Field of Search ..... 338/21, 22 R, 338/22 SD, 306, 314, 325, 208, 25; 29/612, 610.1, 25.42, 25.03, 613, 619, 620; 361/306.1, 321.2

(56) References Cited

U.S. PATENT DOCUMENTS

| | | | | | |
|---|---|---|---|---|---|
| 3,634,927 | A | * | 1/1972 | Neale et al. | 29/620 |
| 3,669,733 | A | * | 6/1972 | Allington | 29/620 |
| 4,210,996 | A | * | 7/1980 | Amemiya et al. | 29/610 R |
| 4,685,203 | A | | 8/1987 | Takada et al. | |
| 5,493,266 | A | * | 2/1996 | Sasaki et al. | 338/22 R |
| 5,500,996 | A | * | 3/1996 | Fritsch et al. | 29/612 |
| 5,534,843 | A | * | 7/1996 | Tsunoda et al. | 338/22 R |
| 5,561,587 | A | * | 10/1996 | Sanada | 361/306 |
| 5,963,416 | A | * | 10/1999 | Honda et al. | 361/306.1 |
| 6,004,471 | A | * | 12/1999 | Chuang | 216/16 |
| 6,010,393 | A | * | 1/2000 | Kawase et al. | 451/41 |
| 6,078,250 | A | * | 6/2000 | Ueda et al. | 338/313 |
| 6,090,435 | A | * | 7/2000 | Ueno | 427/79 |
| 6,171,644 | B1 | * | 1/2001 | Jinno et al. | 29/620 |
| 6,184,772 | B1 | * | 2/2001 | Kawase | 338/22 R |

FOREIGN PATENT DOCUMENTS

| | | | |
|---|---|---|---|
| GB | 1287930 | | 12/1969 |
| JP | 4-261001 | | 9/1992 |
| JP | 5-243007 | | 9/1993 |
| JP | 06312406 | | 10/1994 |
| JP | 7-74005 | | 3/1995 |
| JP | 08236308 | | 9/1996 |
| JP | 9-17609 | * | 1/1997 |
| JP | 9-55303 | | 2/1997 |

* cited by examiner

*Primary Examiner*—Carl J. Arbes
*Assistant Examiner*—Minh Trinh
(74) *Attorney, Agent, or Firm*—Beyer Weaver & Thomas LLP

(57) ABSTRACT

A chip thermistor has a pair of outer electrodes opposite each other with a specified distance in between on one of the surfaces of a thermistor element and an inner electrode extending inside the thermistor element so as to overlap these outer electrodes in the direction perpendicular to the surface on which the outer electrodes are formed. An electrically insulating layer is preferably formed on the same surface as and between the pair of outer electrodes. Each of the outer electrodes may be formed with two or more layers, the outermost of the layers being of gold. The resistance value of such a chip thermistor can be adjusted by abrading at least a portion of the edges of the thermistor element together with portions of the outer electrodes.

8 Claims, 4 Drawing Sheets

METHOD OF PRODUCING CHIP THERMISTORS

This application is a division of application Ser. No. 09/124,194 filed Jul. 28, 1998 now U.S. Pat. No. 6,184,772.

BACKGROUND OF THE INVENTION

This invention relates to a method of producing chip thermistors of the type which are commonly used for the protection of an electronic circuit or as, a temperature-detecting sensor and, more particularly, to a method of producing chip thermistors having electrodes formed overlappingly both on an outer surface of and inside a thermistor element, as well as to a method of adjusting the resistance of such a chip thermistor.

The demand to be surface-mountable directly to a circuit board is just as strong on thermistors as on other kinds of electronic components. For this reason, many kinds of thermistors in the form of a chip (or chip thermistors) have been considered. FIG. 8A shows an example of prior art chip thermistor 61 having outer electrodes 63 and 64 formed at both end parts of a thermistor element 62. Each of the outer electrodes 63 and 64 is formed on one of the end surfaces and reaches the four side surfaces adjacent thereto such that the chip thermistor 61 can be surface-mounted, say, by soldering to electrode lands on a printed circuit board.

Inside the thermistor element 62, there may be inner electrodes 65, 66 and 67 each electrically connected to one of the outer electrodes 63 and 64, as shown in FIG. 8B, such that the resistance between the outer electrodes 63 and 64 is determined not only by the specific resistance (or the resistivity) of the thermistor element 62 but also the overlapping areas of the inner electrodes 65–67.

FIG. 8C shows another chip thermistor 68 of a kind having no inner electrodes inside its thermistor element 62. In this case, the resistance between the outer electrodes 63 and 64 is determined by the distance therebetween and the specific resistivity of the thermistor element 62.

FIG. 9 shows still another prior art chip thermistor 71 characterized as having outer electrodes 73 and 74 formed opposite each other on the upper surface of a thermistor element 72 of a semiconductor ceramic material such that they are separated by a specified distance D. In this example, the resistance is adjusted by the distance D of separation between the outer electrodes 73 and 74. Thus, this distance D must be changed for each type or lot of thermistors to be mass-produced, corresponding to the desired resistance. If the desired resistance value is very small, in particular, the distance of separation D must accordingly be made small, but if this distance D is made too small, the two outer electrodes 73 and 74 may contact each other. Since the rate of change in resistance per unit change in distance D becomes large as D is made smaller, it becomes difficult to control the resistance value and hence the variation in the resistance values of the obtained products also becomes large.

With prior art chip thermistors of the types shown in FIGS. 8A, 8B and 8C at 61 and 68, the variation $3\sigma/x$ (where a is the standard deviation and x is the average) in the resistance values is fairly large, being about 4–10%. Thus, there has been a strong demand to reduce this variation, say, to within about ±1%, but it has been very difficult to respond to this demand. Another problem of this type of prior art chip thermistors was that a fillet is likely to be formed by a solder while it extends upward as it is surface-mounted, say, onto a printed circuit board from the bottom sides 63*a* and 64*a* of the outer electrodes 63 and 64 because this would make a high-density mounting difficult. Because of their shape, furthermore, these bottom sides 63*a* and 64*a* of the outer electrodes 63 and 64 cannot easily be bonded by a so-called bump-bonding method which is frequently used for effecting a high-density mounting.

SUMMARY OF THE INVENTION

It is therefore an object of this invention a to method of producing to provide an improved type of chip thermistors of which the variation in the resistance values can be reduced.

It is another object of this invention to a method of producing provide such chip thermistors which can be surface-mounted at a high density, allowing the use of a bump-bonding method.

It is a further object of this invention to provide a method of adjusting resistance values of such chip thermistors.

A chip thermistor embodying this invention, with which the above and other objects can be accomplished, may be characterized as having a pair of outer electrodes formed opposite each other with a specified distance therebetween on one of the surfaces of a thermistor element and an inner electrode extending inside the thermistor element so as to overlap with these outer electrodes in the direction perpendicular to the surface on which the outer electrodes are formed. According to a preferred embodiment of the invention, an electrically insulating layer is disposed on the same surface as and between the pair of outer electrodes. Each of the outer electrodes may be formed with two or more layers, the outermost of the layers being of gold. The resistance value of such a chip thermistor can be adjusted by abrading at least a portion of the edges of the thermistor element together with portions of the outer electrodes.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like or equivalent components are indicated by the same numerals even where they are components of different devices and may not necessarily be described repetitiously.

DETAILED DESCRIPTION OF THE INVENTION

Figure 1:
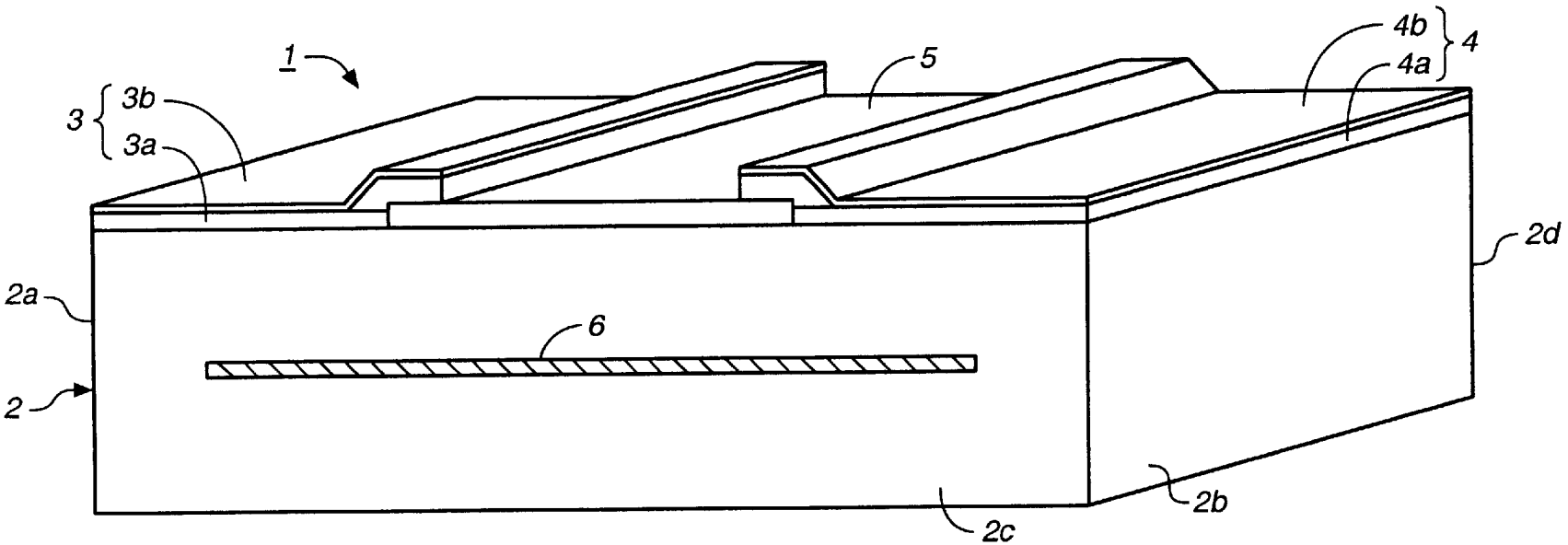
FIG. 1 is a schematic diagonal view of a chip thermistor embodying this invention.

FIG. 1 shows a chip thermistor 1 embodying this invention, having a rectangular planar thermistor element 2 which may comprise a semiconductor ceramic material with a positive or negative temperature coefficient. A pair of outer electrodes 3 and 4 is formed on the upper surface of the thermistor element 2, separated from each other with a specified distance (herein referred to as "the gap") between their inner end edges oppositely facing each other and without covering the side surfaces of the planar thermistor element 2. Each of these outer electrodes 3 and 4 has a solder layer 3*b* or 4*b* of Au formed on top of an Ag—Pd layer 3*a* or 4*a* obtained by applying and firing an Ag—Pd paste. Their outer edges reach end surfaces 2*a* and 2*b* of the thermistor element 2, respectively. An electrically insulating layer 5 is formed directly on a center portion of the upper surface of the thermistor element 2 by burning a glass paste. As shown in FIG. 1, the inner end edges of the outer electrodes 3 and 4 reach the upper surface of the insulating layer 5. The invention does not limit the kind of glass paste which is used for forming the insulating layer 5.

Examples of glass paste which may be used for the purpose of this invention include those having lead borosilicate glass, zinc borosilicate glass, Bi borosilicate glass or Pb—Zn—Bi borosilicate glass as the main component. Alternatively, a synthetic resin such as polyimide resin, phenol resin or vinyl resin, synthetic rubber such as fluorine rubber, natural rubber or a material having an appropriate filler such as silica dispersed within such a resin or rubber material may be used for forming the insulating layer 5. In this case, however, the inner end edge parts of the outer electrodes 3 and 4 are formed so as to be under the lower surface of the insulator layer 5 because the insulating layer 5 is formed after the two outer electrodes 3 and 4 are formed by a burning process.

An inner electrode 6 is inside the thermistor element 2, not contacting the outer electrodes 3 and 4 and serving as a third electrode extending so as to overlap the outer electrodes 2 and 3 in the direction perpendicular to the surface on which the outer electrodes 2 and 3 are formed. The (third) inner electrode 6 may be formed by applying an electrode-forming paste by a printing process and carrying out a burning process simultaneously as the thermistor element 2 is produced.

The chip thermistor 1 thus formed can be surface-mounted, say, to a printed circuit board by connecting the outer electrodes 3 and 4 to electrode lands on the circuit board. Since each of the outer electrodes 3 and 4 is formed so as to have a flat smooth surface on the same surface of the thermistor element 2, a bump-bonding method can be used easily for the connection of the outer electrodes 3 and 4 to the circuit board.

Figure 2:
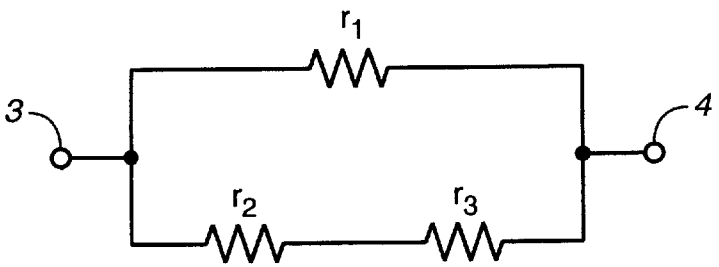
FIG. 2 is an equivalent circuit diagram of the chip thermistor of FIG. 1.

The resistance characteristic of the chip thermistor 1 is critically dependent on the areas of the outer electrodes 3 and 4, the distance of separation therebetween and the thickness of the thermistor element 2. The chip thermistor 1 as described above may be considered to have the circuit structure as shown by an equivalent circuit diagram of FIG. 2, having a first resistance $r_1$ between the first and second outer electrodes 3 and 4 connected in parallel with the series connection of a second resistance $r_2$ between the electrodes 3 and 6 and the third resistance $r_3$ between the electrodes 4 and 6.

Not only are chip thermistors embodying this invention easier to surface-mount than conventional chip thermistors, as described above, but the variation in their resistance values can be effectively reduced. This comes about because of the way the chip thermistors as described above can be produced. A method of producing chip thermistors as described above will be explained next with reference to FIG. 3.

Figure 3A:
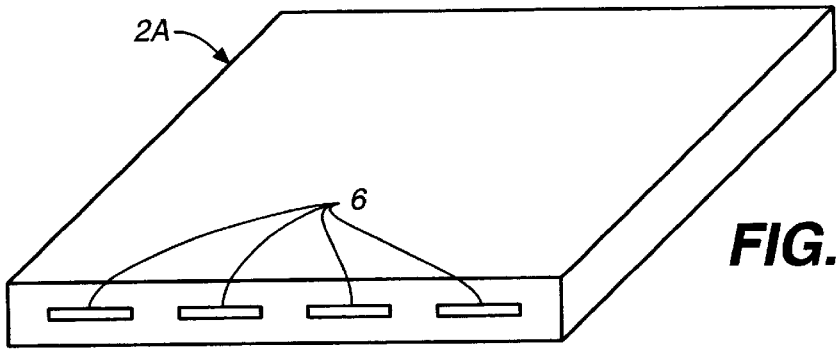
FIGS. 3A, 3B, 3C, 3D and 3E (together referred to as FIG. 3) are drawings for showing a method of producing chip thermistors as shown in FIG. 1.
Figure 3B:
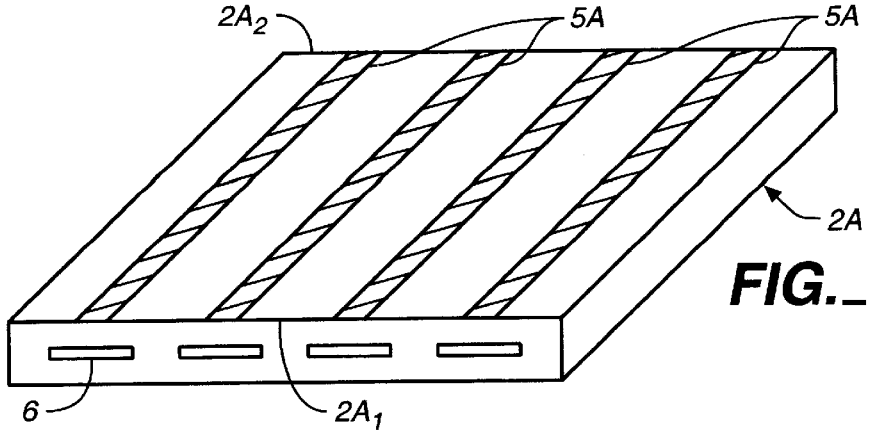
Figure 3C:
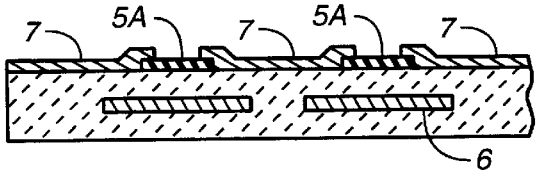
Figure 3D:
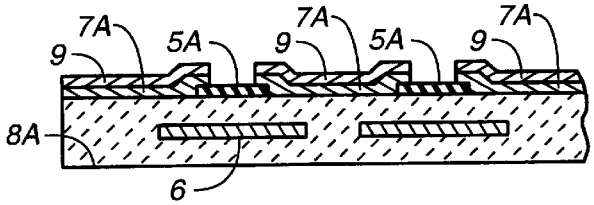
Figure 3E:
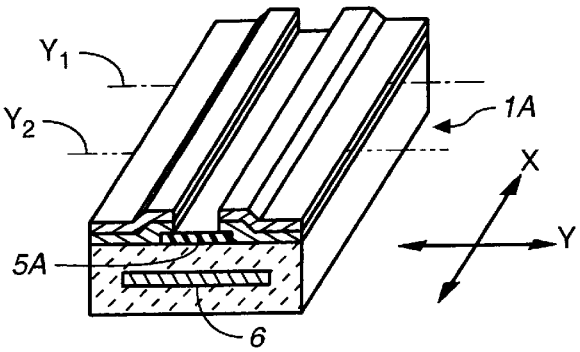

For producing chip thermistors as shown in FIG. 1, a rectangular mother thermistor wafer 2A having inner electrodes 6 already formed inside and externally exposed as shown in FIG. 3A is prepared. Next, a glass paste is applied by a screen printing process on mutually parallel areas on the thermistor wafer 2A, and the insulating layers 5A for the chip thermistor 1 are formed by a burning process. As shown in FIG. 3B, these insulating layers 5A are formed on the surface of the thermistor wafer 2A so as to extend from one of its side edges ($2A_1$) to the opposite side edge $2A_2$. Next, the upper surface of the thermistor wafer 2A is coated with an Ag—Pd paste 7 by printing, as shown in FIG. 3C, such that the side edges of each strip of the insulating layer 5 are covered by the paste 7. Next, heat is applied to subject the Ag—Pd paste 7 to a burning process so as to form Ag—Pd layers 7A. Next, solder layers 9 are formed on the Ag—Pd layers 7A by soldering with Au, as shown in FIG. 3D. Finally, a mother thermistor 1A, as shown in FIG. 3E, is obtained by dicing the thermistor wafer 2A parallel to the direction in which the insulating layers 5 extend (referred to as the X-direction, as shown in FIG. 3E) and along center lines in the direction of the width of each Ag—Pd layers 7A.

Thereafter, the resistance of the mother thermistor 1A is measured, the length to which it should be diced in order to obtain therefrom a chip thermistor having a specified target resistance value is determined on the basis of this measured resistance value, and the mother thermistor 1A is diced in the Y-direction (perpendicular to the X-direction, as shown also in FIG. 3E) along two lines Y1 and Y2 separated by an appropriate distance, thereby obtaining a chip thermistor 1 with an externally exposed inner electrode 6 as shown in FIG. 1.

Since the resistance values of the individual chip thermistors thus produced are determined as they are produced from their mother thermistors by dicing, the variation in their resistance values can be effectively reduced. This is so firstly because the outer electrodes 3 and 4 are formed so as to reach the top end of the end surfaces 2*a* and 2*b* of the thermistor element 2 and the resistance of the mother thermistor 1A is determined according to the accuracy of dicing in the X-direction for obtaining the mother thermistor 1A as shown in FIG. 3E. Since the dicing can be carried out very accurately, the resistance value of the mother thermistor 1A can be very accurately controlled. Secondly, the separation between the lines $Y_1$ and $Y_2$ along which the mother thermistor 1A is diced is determined on the basis of the actually measured resistance value of the mother thermistor 1A. Since the dicing can be carried out very accurately, as explained above, chip thermistors 1 with very small variations in the resistance values can be obtained.

In summary, the outer electrodes 3 and 4 of the chip thermistor 1 are formed so as to extend to the top end of the end surfaces 2*a* and 2*b* of the rectangular thermistor element 2 and also to the side surfaces 2*c* and 2*d* such that its resistance value is determined by the dicing processes carried out both in the X-direction and in the Y-direction. Thus, the variation in the resistance due, for example, to the variation in the areas of electrodes formed by screen printing can be reduced according to the present invention The resistance value of the chip thermistor 1 according to this invention can be varied also by adjusting the position of the inner electrode 6 while keeping the thickness of the thermistor element 2 constant. Thus, when chip thermistors having different resistance values are produced by using thermistor elements of the same size, variations in the occurrence of chips and cracks caused by the polishing for the adjustment of resistance can also be reduced.

This invention also relates to a method of adjusting the resistance value of a chip thermistor, as described above and produced as described above, by abrading at least a portion of an edge or edges of the thermistor element together with portions of the outer electrodes.

As a test of this invention, a chip thermistor as shown in FIG. 1 was subjected to a barrel polishing process by using abrading balls of diameters 3–5 mm and water to abrade its edge portions. Throughout herein, the expression "edge portions" will be used to indicate the portions of the generally planar rectangular thermistor element along all its edges. As the edge portions are thus abraded, the areas of the first and second outer electrodes 3 and 4 become smaller, and this is how the resistance value of the chip thermistor 1 can be adjusted. In other words, chip thermistors with a desired target resistance value can be easily obtained by a barrel polishing process and the yield can thus be improved.

Figure 4:
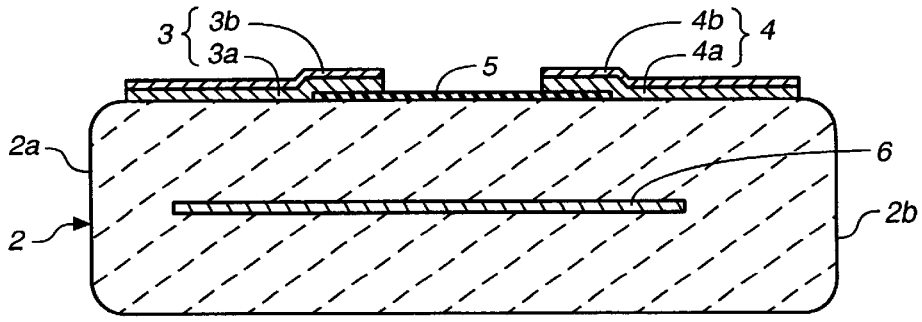
FIG. 4 is a sectional view of a chip thermistor of which the resistance value has been adjusted by a method of this invention.
Figure 5:
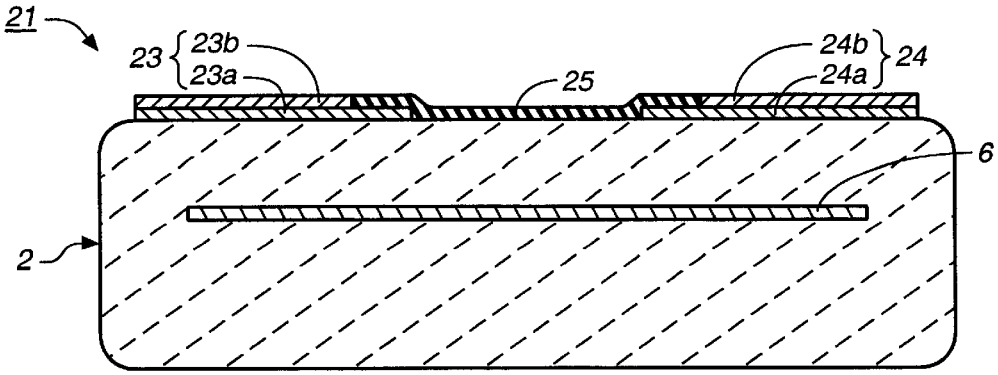
FIG. 5 is a sectional view of another chip thermistor embodying this invention.

FIG. 5 shows another chip thermistor 21 embodying this invention which is similar to the chip thermistor 1 described above with reference to FIG. 1 but is different therefrom in that its outer electrodes 23 and 24 each consist an Ag—Pd layer 23*a* or 24*a* and a solder layer 23*b* or 24*b* thereon such that inner edge parts of the Ag—Pd layers 23*a* and 24*a* facing each other are exposed and an electrically insulating layer 25 is formed not only over the area between the two outer electrodes 23 and 24 but also on the exposed inner edge parts of the Ag—Pd layers 23*a* and 23*b* so as to contact the inner edges of the solder layers 23*b* and 24*b* which face each other. Such a chip thermistor 21 may be produced firstly by forming the Ag—Pd layers 23*a* and 23*b* on a thermistor element 2, secondly by applying and burning a glass paste to form the insulating layer 25, and thirdly by forming the solder layers 23*b* and 24*b*. Alternatively, the solder layers 23*b* and 24*b* may be formed first on the respective Ag—Pd layers 23*a* and 24*a* as shown in FIG. 5, say, by using a mask, the insulating layer 25 being formed thereafter. FIG. 5 shows the edge portions of the thermistor element 2 rounded, indicating that its resistance value has been adjusted by the method described above with reference to FIG. 4.

Although outer electrodes having an Ag—Pd layer and a solder layer of Au have been described above, the layer structure described above for illustration is not intended to limit the scope of the invention. The materials and the structure of the outer electrodes are not intended to limit the scope of the invention. They may be of a single metallic material. Alternatively, a different combinations of metals may be used.

Figure 6:
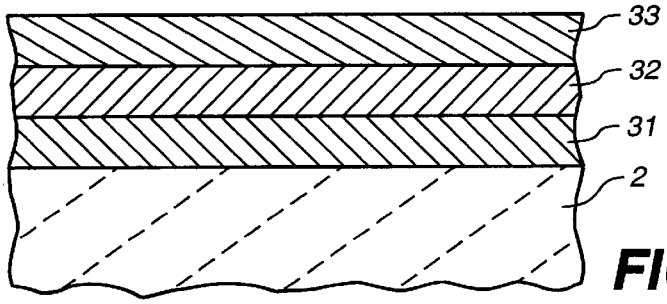
FIG. 6 is a sectional view of a portion of an outer electrode structured differently according to this invention.

FIG. 6 shows an example of an outer electrode structured differently, having three metallic layers 31, 32 and 33 formed one on top of another on a thermistor element 2. These layers may be formed by any of commonly used methods for forming thin films such as burning an electrically conductive paste, sputtering, vapor deposition and soldering. The thickness of each of the layers 31, 32 and 33 may be varied appropriately. The present inventors have ascertained that chip thermistors as shown at 1 in FIG. 1 with small variations in their resistance values can be obtained by using any of the six combinations of metals shown in Table 1 to form the three metallic layers 31, 32 and 33 of their outer electrodes.

TABLE 1

| Combination No. | Layer 31 | Layer 32 | Layer 33 |
|---|---|---|---|
| 1 | NiCr | NiCu | Au |
| 2 | Ti | Pd | Au |
| 3 | Ti | Pt | Au |
| 4 | NiCr | Ag | Au |
| 5 | Ag | Ni | Au |
| 6 | Ag | Cr | Au |

Figure 7:
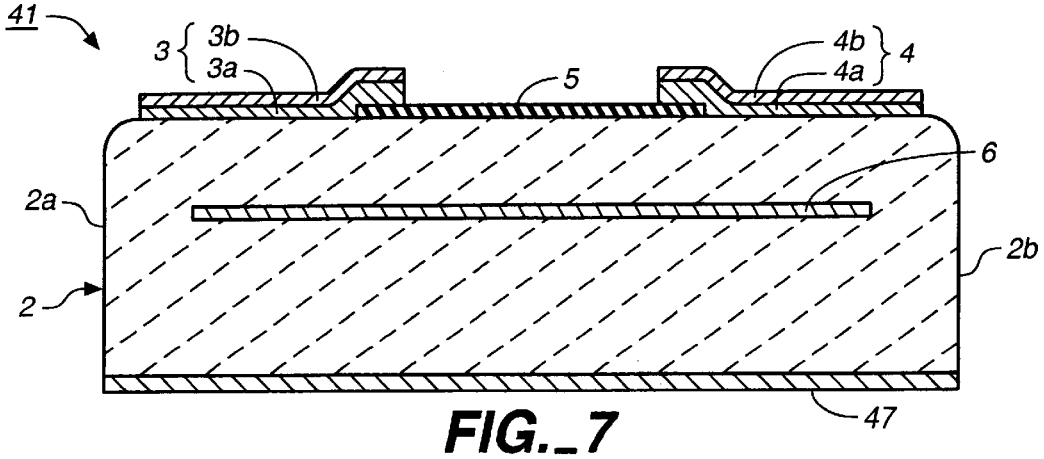
FIG. 7 is a sectional view of still another chip thermistor embodying this invention.
Figure 8A:
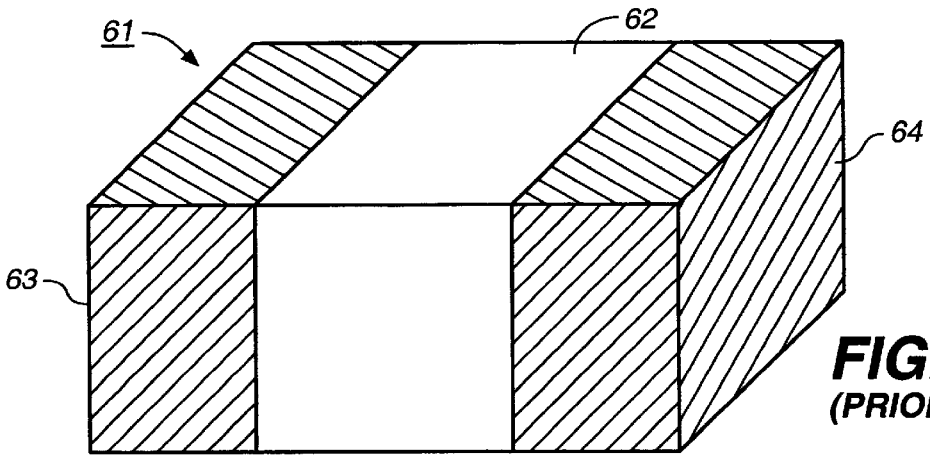
FIG. 8A (PRIOR ART)
FIG. 8A is a diagonal view of a prior art chip thermistor.
Figure 8B:
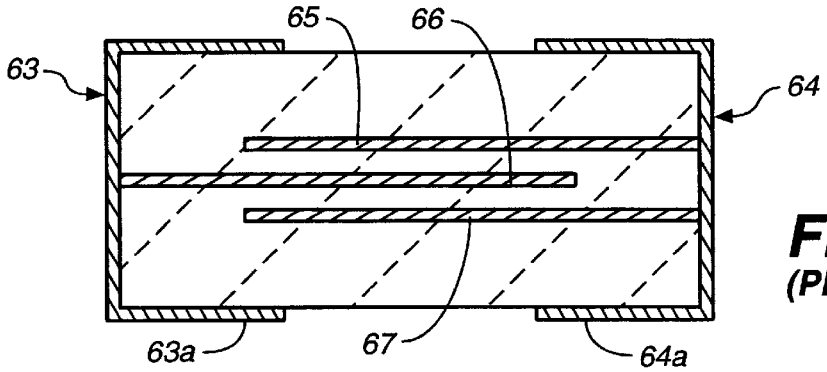
FIG. 8B (PRIOR ART)
FIG. 8B is its sectional view.
Figure 8C:
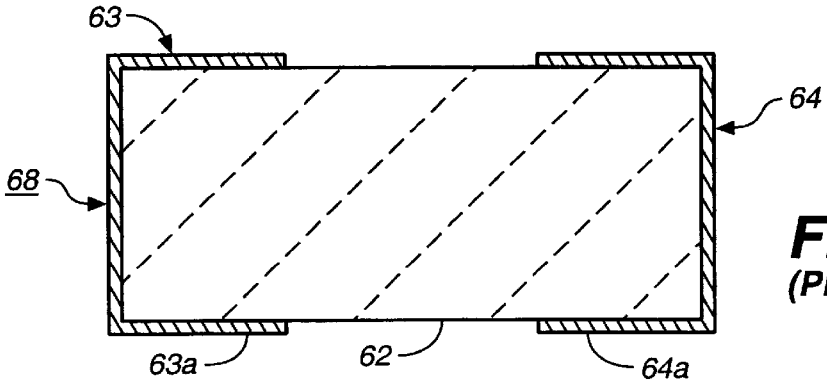
FIG. 8C (PRIOR ART)
FIG. 8C is a sectional view of another prior art chip thermistor.
Figure 9:
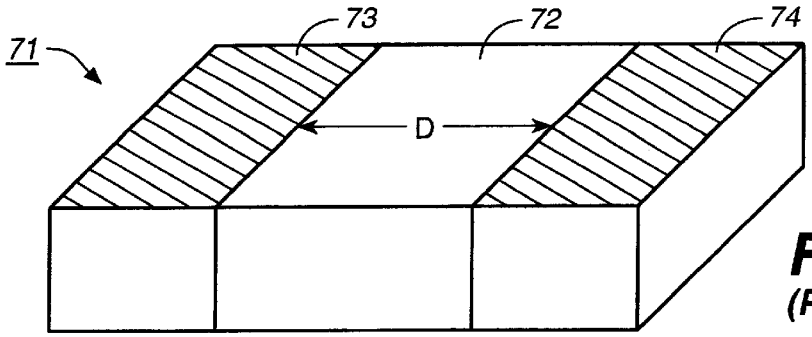
FIG. 9 (PRIOR ART)
FIG. 9 is a diagonal view of still another prior art chip thermistor.

FIG. 7 shows still another chip thermistor 41 embodying this invention which is similar to the chip thermistor 1 or 21 described above but is different therefrom in that a protective layer 47 is formed on the bottom surface of the thermistor element 2. Because of the protective layer 47 on the bottom surface, it is mostly the edge portions around the upper surface of the thermistor element 2 that are rounded off when the resistance value of the chip thermistor 41 is adjusted.

The present inventors have had many chip thermistors of this kind produced by using thermistor elements 2 with width 0.5 mm, length 1.0 mm, thickness 0.3 mm and resistivity about 2 kΩcm and by varying the distance d between the top surface of the thermistor element 2 and the inner electrode 6 so as to vary their resistance values. The resistance values $R_{25}$ of these different kinds of chip thermistors 41 at 25° C. and their deviations $R_{3cv}(3\sigma/x)$ are shown in Table 2. Table 2 proves clearly that chip thermistors with different resistance values can be obtained easily by varying the height of the inner electrode and also that the variations in the resistance values are extremely small.

TABLE 2

| d (mm) | R25 (kΩ) | R3cv (%) |
|---|---|---|
| 0.16 | 30.1 | 3.3 |
| 0.12 | 22.5 | 3.4 |
| 0.08 | 17.3 | 3.2 |

Chip thermistors embodying this invention have many advantages. Firstly, since the outer electrodes are formed opposite to each other on the same surface of the thermistor element, the chip thermistor can be easily surface-mounted to a printed circuit board. Secondly, since the outer electrodes have flat and smooth surface areas on the same surface of the thermistor element, fillets are not formed outside the thermistor element at the time of the surface-mounting. Thus, chip thermistors of this invention can be surface-mounted not only at a high density but also by a bump-bonding process. Thirdly, since the outer electrodes are formed opposite to each other with a specified distance therebetween on the same surface of the thermistor element, chip thermistors of this invention can be obtained by first producing a mother thermistor and then by dicing this mother thermistor. Since the dicing can be carried out very accurately, the variation in their resistance values can be easily reduced. Fourthly, with the presence of an inner electrode overlapping the outer electrode in the direction perpendicular to the surface on which the outer electrodes are formed, the overall resistance value of the chip thermistor can be reduced and the variation in the resistance values of produced chip thermistors can also be reduced. If an insulating layer is provided between the pair of outer electrodes, the stability of the surface resistance between the outer electrodes is improved. This comes about because the insulating layer thus formed serves to protect the semiconductor ceramics of the thermistor element from environmental elements such as moisture and dust particles.

What is claimed is:

1. A method of producing a chip thermistor with a specified resistance value, said method comprising the steps of:

preparing a thermistor element having a top surface with edges, a pair of outer electrodes disposed opposite each other with a gap of a specified width therebetween on said top surface of said thermistor element and an inner electrode not connected to said outer electrodes and extending parallel to said top surface inside said thermistor element so as to overlap with said pair of outer electrodes with reference to a direction perpendicular to said top surface; and abrading at least a portion of said edges of said thermistor element together with said pair of outer electrodes to adjust resistance of said chip thermistor to said specified resistance value.

2. The method of claim 1 wherein said chip thermistor also has an electrically insulating layer disposed on said top surface of said thermistor element between said pair of outer electrodes.

3. The method of claim 1, wherein said outer electrodes each consist of two or more layers, the outermost of said layers being a gold layer.

4. The method of claim 2 wherein said outer electrodes each consist of two or more layers, the outermost of said layers being a gold layer.

5. The method of claim 1 wherein said thermistor element is planar and has side surfaces which are perpendicular to said top surface and are not covered by said outer electrodes.

6. The method of claim 5 wherein said outer electrodes each consists of two or more layers, the outermost of said layers being a gold layer.

7. The method of claim 5 wherein skid inner electrode is externally exposed at said side surfaces.

8. The method of claim 6 wherein said inner electrode is externally exposed at said side surfaces.

* * * * *